US006183380B1

(12) United States Patent
Yim

(10) Patent No.: US 6,183,380 B1
(45) Date of Patent: Feb. 6, 2001

(54) DUAL FACE GOLF PUTTER

(76) Inventor: Hyung Jin Yim, 43977 Beretta Dr., Fremont, CA (US) 94539

( * ) Notice: Under 35 U.S.C. 154(b), the term of this patent shall be extended for 0 days.

(21) Appl. No.: 09/327,215

(22) Filed: Jun. 7, 1999

Related U.S. Application Data

(62) Division of application No. 08/992,067, filed on Dec. 17, 1997, now Pat. No. 6,142,884.
(60) Provisional application No. 60/033,365, filed on Dec. 18, 1996.

(51) Int. Cl.[7] ..... A63B 53/04
(52) U.S. Cl. ..... 473/330; 473/340
(58) Field of Search ..... 473/324, 325, 473/330, 331, 251, 252, 253, 254, 340, 313; D21/736, 738

(56) References Cited

U.S. PATENT DOCUMENTS 3,989,257 * 11/1976 Barr .
4,077,633 * 3/1978 Studen .
4,162,074 * 7/1979 Thomson .
5,863,262 * 1/1999 Donofrio .

* cited by examiner

*Primary Examiner*—Sebastiano Passaniti

(57) ABSTRACT

A putter benefiting from the use of a striking surface which is composed of a flat and a curved face. The faces are connected smooth and piece-wise so that the continuous striking surface is forgiving to putting inconsistencies.

3 Claims, 3 Drawing Sheets

DUAL FACE GOLF PUTTER

RELATED APPLICATIONS

This application is a divisional of Ser. No. 08/992,067 filed Dec. 17, 1997 now U.S. Pat. No. 6,142,884.

Provisional application Ser. No. 60/033,365 filed Dec. 18, 1996 is incorporated herein by reference. Ser. No. 08/992,067 is also incorporated by reference.

BACKGROUND—FIELD OF INVENTION

This invention relates generally to golf clubs and more particularly to a putter head wit a dual face striking surface.

BACKGROUND—DESCRIPTION OF PRIOR ART

The game of golf is generally known and has been around for many generations. It is a game of accuracy, wherein the accuracy is based on the lowest score possible. The score is determined by the number of strokes required to place a golf ball in a cup which resides on a putting green.

There are many factors involved in reducing a golfer's score. One of the biggest factors involved in reducing the score is the use of proper clubs, more particularly the golf putter. A well designed golf putter should include features that promote accuracy, consistency, and forgiveness to minor errors. Perhaps one of the most common errors made by putters is that of forward hand push. By pushing the hands to far ahead of the ball, the slight positive loft either becomes zero or negative. This negative loft induces a compression into the ground at contact creating a harsh feel. From this point the ball tends to bounce, skip, skid, and roll towards it's target. This series of events produces inconsistent putting.

Due to the foregoing problems, it is preferred that a golfer be provided with a putter face design that is immune to the effects of forward hand push.

There are several putter faces described in the prior art that promote consistent ball roll characteristics.

U.S. Pat. No. 3,989,257 utilizes a pair of elliptical curve's across the face in the vertical and horizontal directions to as to resist inconsistency due to wrist pronation. The idea is that as long as the center of the putter head travels along a perfectly straight path the normal projection from the point of contact's tangent will remain unchanged regardless of wrist rotation. This is not practical, however, since a deviation from a perfect path is more likely than a rotation about the wrists. If this were the case, having a deviation from a perfect putter path and thus a contact non-linear with the path of the center of mass, the trajectory of the ball will be far from straight.

U.S. Pat. No. 4,162,074 hopes to increase accuracy by means of producing top spin. The invent ion uses a face with two substantially flat faces angles so that they intersect to form an outwardly horizontal protrusion. This protrusion is designed such that it contacts the ball below its center and drags upward along the surface of the ball as the golfer's stroke follows through. The problem with this idea is that the putter does not remain in contact with the ball long enough to "drag" the ball into a top spin motion. The impact is in fact a very short impulse in which the bail's trajectory is perpendicular to the tangent of the point of impact. Even if the theory worked, however, the stroke inconsistencies of even the most skilled golfer would cause this near microscopic chain of events to fail.

OBJECT OF THE INVENTION

Besides addressing the matters and problems above, the main object of the present invention is to provide a putter head with a dual face striking surface for maximizing the use of the sweet spot of the putter, regardless of the type of stroke used by the user.

DETAILED DESCRIPTION OF THE INVENTION

Figure 1:
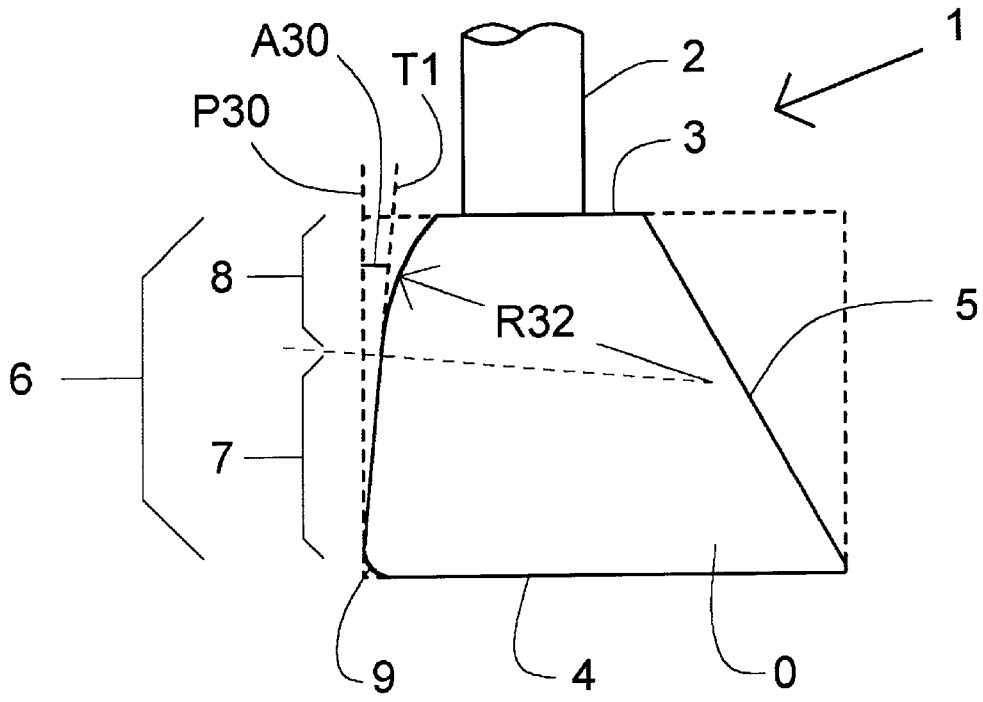
FIG. 1 shows A side view of the putter head.
Figure 2:
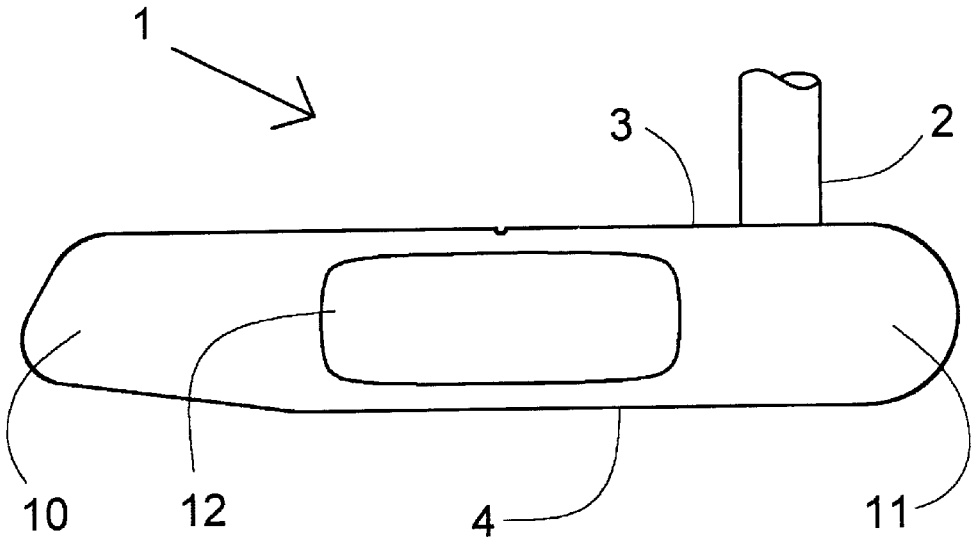
FIG. 2 shows front view of the golf putter.

FIGS. 1–2, show a golf putter 1 comprising a putter head 0 having a top surface 3, bottom surface 4, a striking surface 6 and rear surface 5 and a shaft 2 extended from the top surface 3. The top surface 3 is parallel to the bottom surface 4. The striking surface 6 extends from the top surface 3 to the bottom surface 4 and on the opposite side, the rear surface 5 extends from the top surface 3 to the bottom surface 4. The putter head 0 having a toe portion 10 and heel portion 11. The top surface 3, the bottom surface 4, striking surface 6 and the rear surface 5 extend from the heel portion 11 to the toe portion 10.

FIG. 1 shows the preferred embodiment of the striking surface 6 having dual faces, a first face 7 and a second face 8 and a leading edge 9. The first face 7, being substantially flat, extends from the leading edge 9 to the second face 8. The intersection of the first face 7 and the leading edge 9 may never be greater than 90 degrees with respect to the bottom surface 4. The first face 7 is also lofted at a slight angle A30, zero or greater than zero degrees, with respect to a perfectly vertical plane P30. The second face 8 has a curvature radius R32 such that the face is consistent in the horizontal direction. The second face 8 extends from the first face 7 to the top surface 3. The interface of the first face 7 and the second face 8 is a smooth, piece-wise connection such that the tangent line of the second face 8, at the intersection of the two faces, lays within the plane of the first face 7. The leading edge 9 is slightly rounded so that it will not catch on any putting surfaces.

Figure 3:
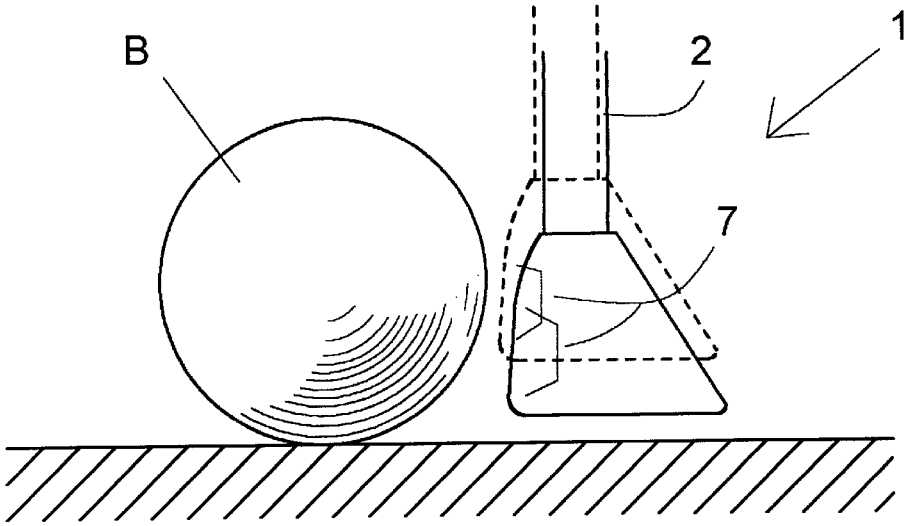
FIG. 3 shows a putting set up with a varied putter head level from the putting surface.
Figure 4:
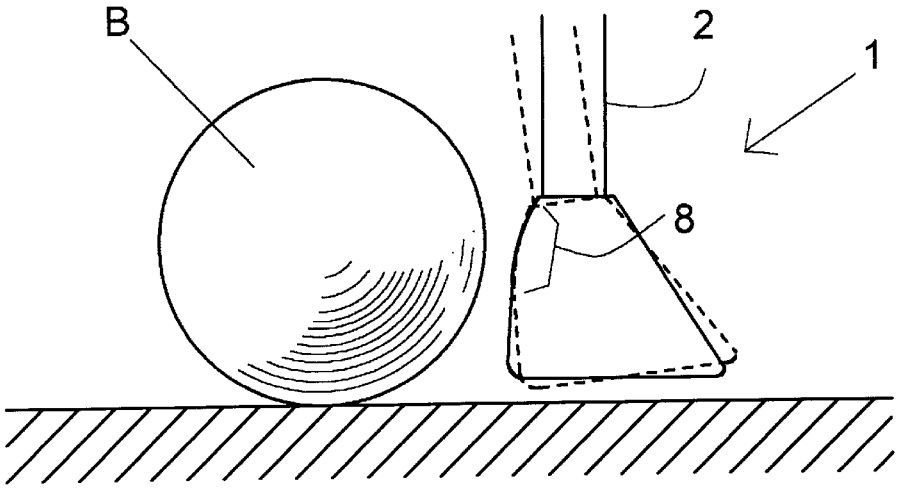
FIG. 4 shows a tilted putter face (dotted line) vs. a proper vertical putter face position (solid line).
Figure 5:
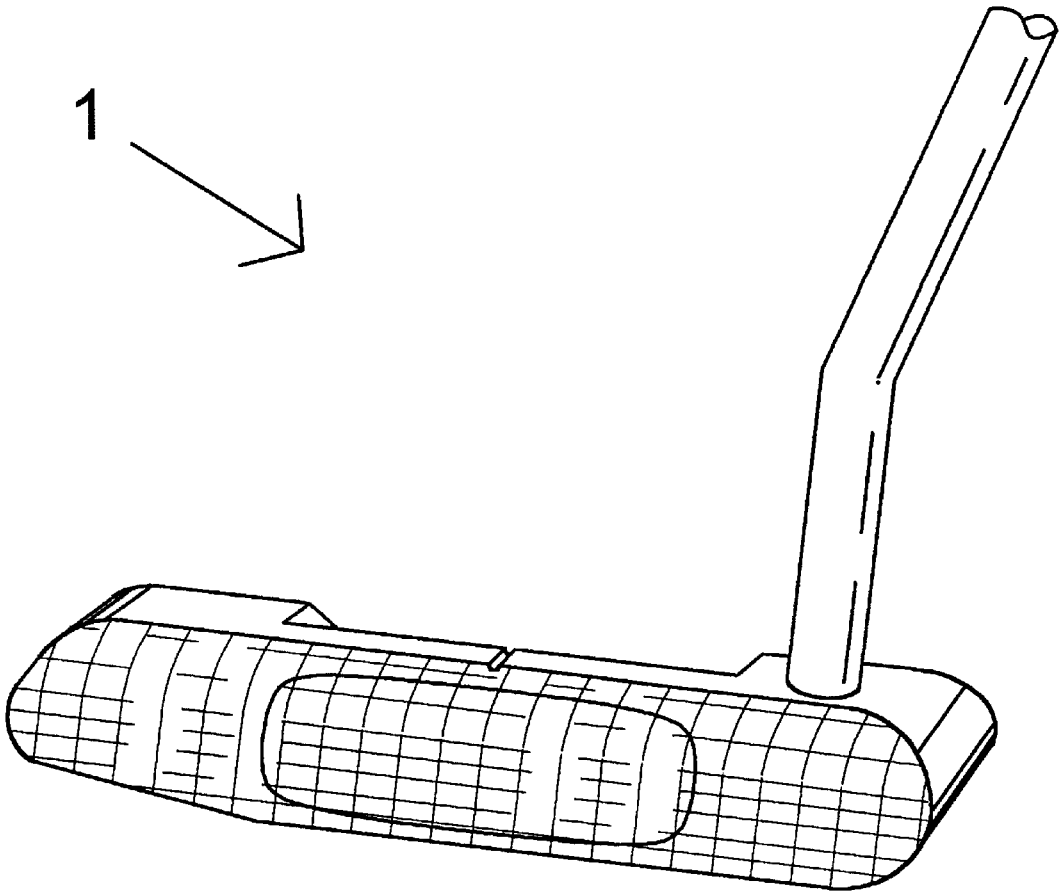
FIG. 5 shows a perspective view of the putter head.

The most significant aspect of the invention is the first face 7 and a tangent of the second face 8 at the interface between the first face 7 and the second face 8 are in the same plane such that the faces are smooth and continuous. This transition of first face 7 and second face 8 will allow a golfer to utilize the sweet spot area 12 of the putter head 0 most effectively, regardless of stroke type. For example, when the golfer strikes the ball B using a proper stroke, the first face 7 is utilized as a sweet spot and the loft angle is not sensitive of the putter head level from the putting surface as shown in FIG. 3. If, however, the golfer strikes the ball B with the hands pushed forward too much and the striking surface is tilted forward, then the second face 8 is automatically utilized as the sweet spot and retains the proper loft angle to provide a roll as shown in FIG. 4. It should be noted that proportions of the area covered by the faces 7 and 8 are not a limitation and is manufacturers preference.

The preferred material for all the parts of the present invention is steel, although other materials may be substituted without deviating from the spirit of the invention. Specially, materials in the sweet spot area 12 may be substituted with any foreign materials such as plastics, composite materials, etc.

Because many varying and different embodiments may be made within the scope of the present invention concept, and because many modifications may be made in the present inventions, it is to be understood that the above detailed description should be interpreted as illustration and not in a limiting sense. The spirit of the present invention being limited solely by the appended claims.

What is claimed is:

1. A golf putter comprising:

a putter head, the putter head comprising a top surface, a bottom surface, a heel portion and a toe portion;

the putter head further comprises a striking face, wherein the striking face extends vertically from the bottom surface to the top surface and is elongated from the toe portion to the heel portion;

the striking surface further comprises a leading edge formed at the bottom surface, a second face formed at the top surface and a first face formed between the leading edge and the second face;

the first face being substantially flat and having a positive loft with respect to a vertical plane of the striking surface;

the second face having a curvature radius wherein the tangent of the second fade is in the same plane as the first face thereby forming a smooth interface between first face and second face; and a sweet spot defined at the center of the putter head striking face and contained within the first face and the second face.

2. The golf putter according to claim 1, wherein the putter head is attached to a shaft.

3. The golf putter according to claim 1, wherein the putter head includes steel material or composite material.

* * * * *